US005546923A

United States Patent [19]

Duncan

[11] Patent Number: 5,546,923

[45] Date of Patent: Aug. 20, 1996

[54] TAKE-DOWN ARCHERY BOW

[76] Inventor: Douglas J. Duncan, 8157 Budworth School Rd., P.O. Box 742, Beetown, Wis. 53802

[21] Appl. No.: 330,831

[22] Filed: Oct. 27, 1994

[51] Int. Cl.[6] ..... F41B 5/00

[52] U.S. Cl. ..... 124/23.1

[58] Field of Search ..... 124/23.1, 24.1, 124/25.6, 86, 88; 403/393

[56] References Cited

U.S. PATENT DOCUMENTS

| | | | |
|---|---|---|---|
| 261,610 | 7/1882 | Howe . | |
| 1,709,630 | 4/1929 | Rounsevelle | 124/23.1 |
| 2,125,591 | 8/1938 | Smith . | |
| 2,228,823 | 1/1941 | Helm | 124/23.1 |
| 2,608,188 | 8/1952 | Howard . | |
| 2,813,818 | 11/1957 | Pearson | 124/23.1 X |
| 3,156,230 | 11/1964 | Groves . | |
| 3,527,196 | 9/1970 | Karbo | 124/24.1 |
| 3,612,028 | 10/1971 | Karbo . | |
| 3,738,348 | 6/1973 | Karbo . | |
| 3,766,904 | 10/1973 | Izuta . | |
| 3,771,508 | 11/1973 | Black et al. . | |
| 3,814,075 | 6/1974 | Hoyt, Jr. . | |
| 3,821,946 | 7/1974 | Griggs . | |
| 3,874,360 | 4/1975 | Armstrong et al. . | |
| 3,921,598 | 11/1975 | Helmick . | |
| 3,942,506 | 3/1976 | Izuta . | |
| 3,957,027 | 5/1976 | Drake | 124/88 |
| 4,091,790 | 5/1978 | Hoyt, Jr. . | |
| 4,574,766 | 3/1986 | Izuta . | |
| 4,674,468 | 6/1987 | Izuta . | |
| 4,693,230 | 9/1987 | Sugouchi | 124/88 |
| 4,793,319 | 12/1988 | Vaughan et al. . | |
| 5,025,774 | 6/1991 | Martin | 124/89 |
| 5,280,779 | 1/1994 | Smith | 124/88 |
| 5,291,874 | 3/1994 | Harrison | 124/23.1 |

OTHER PUBLICATIONS

Traditional Bowhunter, No. 76695, Aug./Sep., 1993, pp. 46–47.

*Primary Examiner*—Eric K. Nicholson
*Assistant Examiner*—John A. Ricci
*Attorney, Agent, or Firm*—Armstrong, Westerman, Hattori, McLeland & Naughton

[57] ABSTRACT

An archery bow having a belly and a back and comprising two elongated branch components each having an end, the ends being detachably joined together at a joint with at least one releasable fastener. The joint is defined by mating surfaces on the ends of each component and is between the belly and the back of the bow. The mating surfaces of each component have a first curved surface extending to the bow belly and a second curved surface extending to the bow back.

18 Claims, 1 Drawing Sheet

FIG. 1
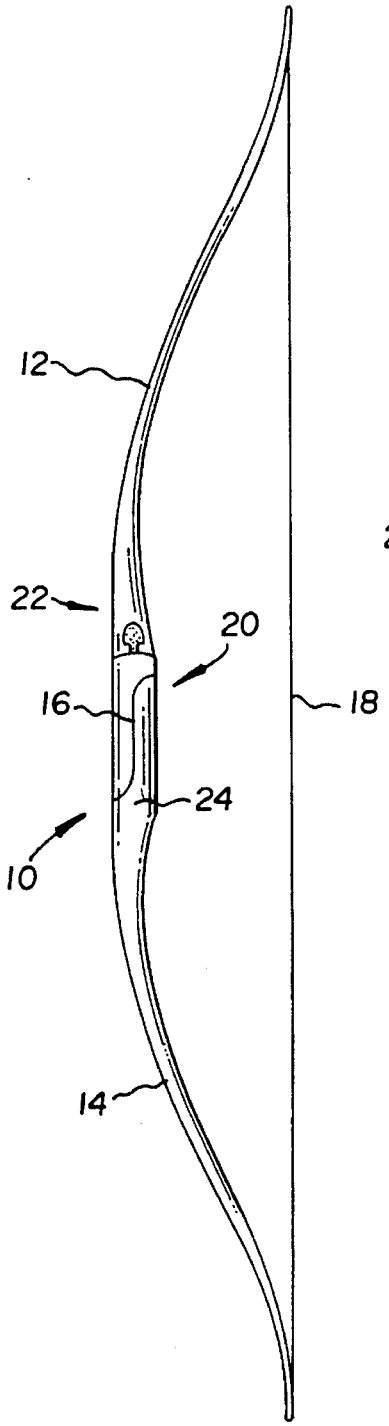
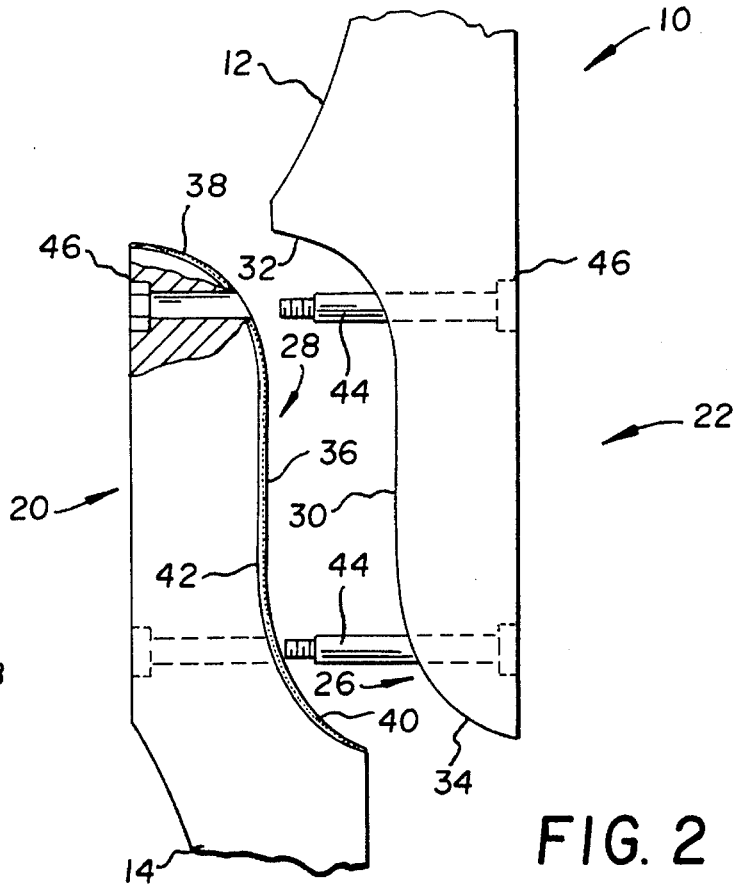
FIG. 2
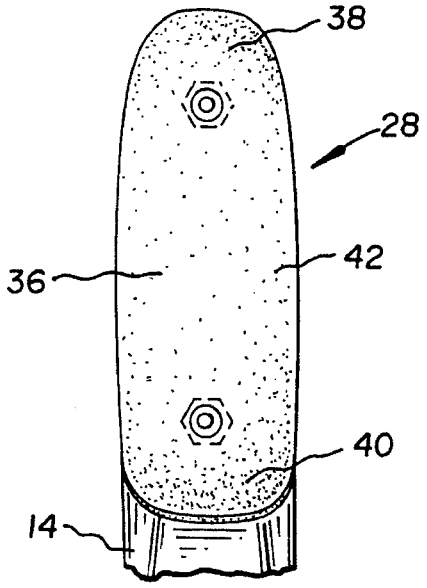
FIG. 3

TAKE-DOWN ARCHERY BOW

The present invention generally relates to archery bows and, more particularly, to archery bows constructed of two or more detachable component parts which are commonly known as "breakdown" or "takedown" archery bows.

While the archery bows of the present invention will be primarily discussed hereinafter with specific reference to archery bows which are capable of being separated into two component parts, it should be recognized that the use and application of the invention are not thereby so limited. For example, the concepts of the archery bows of the present invention may be utilized for the construction of archery bows having three or more component parts where the parts are joined in the manner as disclosed herein.

Archery bows used for recreational purposes such as hunting, target shooting and the like are well known and are generally of a length which at or near the height of the archer using the bow. Thus, archery bows typically have a length on the order of four to six feet with bows at the upper end of the range being in predominate use at present. As is readily apparent, the length of such archery bows presents significant problems in the convenient shipping, storage and transportation of such bows.

It has been long recognized that the above problems or inconveniences with archery bows could be minimized by constructing the bow as a so-called "takedown" bow where the bow is constructed from two or more component parts such that the bow could be disassembled when not in use. An early design for such takedown bows as exemplified U.S. Pat. No. 261,610 to Howe was to provide a joint in the handle portion of the bow so that the bow was comprised of two parts of approximately equal length. The joint between the parts which was adapted to assemble the component parts together in such bows has taken several forms. A typical joint consisted of a socket type joint where a tubular end of one component part of the bow fitted was adapted to fit within a mating socket or sleeve on an end of the other part. An archery bow of this type is also shown in U.S. Pat. No. 5,291,874 to Harrison.

Another approach in the construction of two-piece takedown bows has been to provide planar mating surfaces in the handle portion of the bow as shown and described in U.S. Pat. No. 3,156,230 to Groves. In this construction, the mating surfaces are oblique to the longitudinal axis of the bow and bolts which extend through the mating surfaces are used to releasably join the two parts of the bow together.

Yet another approach in the construction of two-part takedown bows has been to provide mating surfaces on the two branch components of the bow which are normal to the longitudinal axis of the bow and provide a lockable hinge mechanism at these mating surfaces. This approach is exemplified by U.S. Pat. Nos. 3,612,028 and 3,738,348 to Karbo.

Since the greatest bending moments of an archery bow are realized in the central handle portion when in use, the above constructions for a takedown archery bow were not entirely satisfactory. Among other things, because the joint between the two components is located in the central handle where the maximum bending moments are experienced, the joints tend to loosen after repeated use or even could fail. Strengthening the central handle portion to withstand the bending forces tends to make the handle unacceptably bulky and cumbersome. Socket type joints also tend to collect foreign matter and thus are apt to bind or wedge making disassembly difficult. In addition, the joint between the two components tends to cause the bow to produce unacceptable vibrations within the bow during use, these vibrations potentially causing inaccurate shooting by the bow and also discomfort to the user in gripping the bow.

A more complicated construction for takedown archery bows where the bow is constructed of three component parts has also been extensively used, particularly in recurve type bows. In this construction, the handle of the takedown bow is a unitary component and two outwardly directed limbs are secured on either side of the handle to form the bow. Latching or locking mechanisms are provided at each joint between the handle and limb of the bow. Examples of this construction for a takedown archery bow are shown in U.S. Pat. Nos. 3,766,904 to Izuta; 3,874,360 to Armstrong et al; 4,674,468 to Izuta; 5,025,774 to Martin; and 5,280,779 to Smith.

While these latter types of takedown bows have essentially avoided having the highest bending moments occur at the joint of the bow, several additional disadvantages have been introduced by this particular construction. Among others, this type of takedown bow has two joints between the component parts and thus includes an additional structure capable of substandard operation or even failure. Furthermore, the locking or latching mechanisms used to secure the limbs to the handle tend to be complicated and expensive. These locking or latching mechanisms also tend to generate considerable noise when shooting which is both distracting to the archer and may frighten game. Proper alignment of the two limbs relative to each other also has proven to be difficult. In addition, it is somewhat more inconvenient and time consuming to disassemble two joints as opposed to a single joint as in the two component bows.

As mentioned above, takedown type archery bows of both types, because of the joint or joints contained with the bow itself, tend to have different and, most time inferior, operational characteristics as compared with unitary or single-piece type bows. This is primarily due to the nature of the joints or joints provided in the takedown bows which inherently have at least some degree of movement or slack in the joint itself. This slack tends to manifest as different vibrational characteristics and thus a different "feel" of the bows when being used in shooting. Vibrations generated by shooting of the bow are quite complex and are propagated in various elements of the bow and transmitted to the wrist of the archer. These vibrations may affect the accuracy in shooting by the archer and may also provide a degree of discomfort to the archer.

SUMMARY OF THE INVENTION

It is therefore a feature of the subject invention to provide a takedown archery bow of a unique and novel construction which is relatively easy to assemble and disassemble.

It is a further feature of the present invention to provide a takedown archery bow which preferably utilizes a single joint in its construction.

It is also a further feature of the present invention to provide a takedown archery bow which does not add any appreciable weight to the bow and does not modify the shape of the bow.

It is another feature of the present invention to provide a takedown archery bow which provides shooting characteristics comparable and even better than unitary type bows, particularly with respect to the vibrational behavior of the bow by among other things, reducing vibrations when shooting the bow.

It is yet another feature of the present invention to provide a takedown archery bow where the mating surfaces of the joint between the limb components are in snug engagement to prevent relative movement of the branch or limb components.

It is a further feature of the present invention to provide a takedown archery bow which is provides accurate and automatic alignment of the bow during assembly.

It is another feature of the present invention to provide a improved archery bow of minimal complexity and thus minimal cost to manufacture.

Briefly, in its broader aspects, the present invention comprehends an archery bow having a belly and a back comprising two elongated branch components detachably joined together at a joint with at least one releasable fastener, the joint extending from the belly to the back and, forming the joint, an end of each component having a first curved surface extending to the bow belly and a second curved surface extending to the bow back.

The present invention further comprehends an archery bow having a belly and a back comprising two elongated branch components each having an end, the ends being detachably joined together at a joint with at least one releasable fastener, the joint being defined by mating surfaces on the ends of each component and being between the belly and the back of the bow, the mating surfaces of each component having a first curved surface extending to the bow belly and a second curved surface extending to the bow back.

Further features, objects and advantages of the present invention will become more fully apparent from a detailed consideration of the arrangement and construction of the constituent parts as set forth in the following description when taken together with the accompanying drawings.

BRIEF DESCRIPTION OF THE DRAWINGS

In the drawings,

FIG. 1 is a side view of one embodiment of an archery bow embodying the principles of the present invention, FIG. 2 is detailed side view of the handle portion of the archery bow shown in FIG. 1, the view illustrating the configuration of the joint between the two components of the bow and being taken from the side opposite that shown in FIG. 1, and FIG. 3 is a partial side view of one of the lower component for the archery bow of shown in FIGS. 1 and 2 which illustrates a configuration of the surface of the joint of the component of the bow.

DETAILED DESCRIPTION OF THE PREFERRED EMBODIMENTS

Turning first to FIG. 1 of the drawing, shown is a side view of one embodiment of a takedown archery bow in accordance with the present invention. In the embodiment shown, archery bow 10 comprises upper elongated branch component 12 and lower elongated branch component 14 detachably joined together at joint 16. Bowstring 18 is connected to the respective distal ends of components 12 and 14 and is of a length such that bow 10 assumes the shape shown. As is conventional, the surface of bow 10 facing toward bowstring 18 is belly 20 of the bow and the opposed surface is back 22 of the bow. In this embodiment, the lower portion of the upper component 12 and the upper portion of component 14 together form handle grip area 24 of bow 10. Typically, handle area 24 is larger in cross-section than the remainder of components 12 and 14 to provide greater strength for the bow and to provide a convenient area for the archer to grip the bow.

The materials used for forming components 12 and 14 may vary considerably and generally any conventional material used in the fabrication of bows are appropriate for the purposes of the present invention, such materials including wood, metal and fiber reinforced polymers. It is presently preferred that the material for forming components 12 and 14 is a composite of wood and polymeric material such as a compressed wood and phenolic resin composite material sold under the tradename DYMONDWOOD.

Turning now to FIG. 2 which is a detailed partial side view of bow 10 as seen from the opposite side as shown in FIG. 1, joint 16 is defined by mating surface 26 on the lower end of upper component 12 and mating surface 28 on the upper end of lower component 14. Mating surface 26 has planar central portion 30 extending generally parallel to the longitudinal axis of unstrung bow 10. Mating surface 26 further includes first curved surface 32 extending from planar central portion 28 to belly 20 of bow 10 and second curved surface 34 extending from an opposed side of the central portion to the back 22 of the bow. In a like fashion, mating surface 28 of component 14 has planar central portion 36 extending parallel to the longitudinal axis of unstrung bow 10. Mating surface 28 further includes first curved surface 38 extending from planar central portion 28 to belly 20 of the bow and second curved surface 40 extending from an opposed side of the central portion to back 22 of the bow. Thus, in the case of component 12, mating surface 26 comprises a continuous surface formed from first curved surface 32, planar central portion 30 and second curved surface 34. Mating surface 28 of lower component 14 is, of course, in the same configuration to ensure close engagement of the two components 12 and 14 and also accurate alignment of the components relative to each other.

Although first curved surface 32 and second curved surface 34 of mating surface 26 are shown as being of differing curvatures, these two surfaces may be of the same curvature. In addition, the first and second curved surfaces 32 and 34 may be described as being in the shape of a bight and further may be arcuate or semi-circular. Furthermore, central surface 30 preferably is longer than either of curved surfaces 32 and 34 and more preferably is longer than the sum of the two curved surfaces. The same considerations apply to mating surface 28.

As is better shown in FIG. 3, mating surface 28 of lower branch component 14 preferably extends linearly in a direction which is both normal to the longitudinal axis of the bow and also normal to a line extending from the belly of the bow to the back of the bow. Mating surface 26 has a similar orientation. For example, mating surfaces 26 and 28 are perpendicular to the side surfaces of handle portion 18 of bow 10.

In addition, as is shown in FIG. 2, it is presently preferred that first curved surfaces 32 and 38 of mating surfaces 26 and 28 respectively are approximately normal to belly 20 at the point the surfaces intersect with the belly. In a like fashion, it is presently preferred that second curved surfaces 34 and 40 of mating surfaces 26 and 28 respectively are approximately normal to back 22 at the point the surfaces intersect with the back.

Preferably at least part of at least one and possibly both mating surfaces 26 and 28 are provided with covering layer 42 of yieldable and/or flexible material which functions somewhat in the manner of a gasket by being interposed in the joint between the mating surfaces. The layer 42 generally is relatively thin and is formed of a flexible material which can termed yieldable so that the two mating surfaces can conform closely to each other and provide a snug engagement between all portions of mating surfaces 26 and 28. In addition, layer 42 may also provide mating surfaces with greater friction to each other to help maintain the integrity of the joint by minimizing the tendency of the surfaces to slip relative to each other. Layer 42 also helps to reduce the transmission of vibrational forces through the bow by providing a damping function in the joint, such vibrational forces typically created by release of an arrow. A presently preferred material for layer 42 is leather, although cloth, polymeric, or other materials in sheet form may of used if of sufficient yieldability and flexibility.

To secure upper component 12 and lower component 14 together along joint 14, two releasable fasteners 44 extend through bores passing from belly 20 of the bow 10 to back 22 of the bow along lines generally perpendicular to the longitudinal axis of the unstrung bow. The form and construction of fasteners 44 may vary considerably.

In the embodiment shown, fasteners 44 each comprise a bolt having a head or shoulder on one end and a threaded shank on the other end which cooperates with a hexagonal threaded nut. Preferably, the head of the bolt has a hex shaped socket for insertion of an appropriate tool to secure the bolt to the nut. For appearance and safety reasons, the heads and nuts of fasteners 44 are contained in counterbores 46 such that the ends of the fasteners do not project outwardly of the surface of belly 20 and back 22 of the bow. Preferably, nuts are retained in the counterbores 46 by a suitable adhesive which helps to prevent loss of the nuts when bow 10 is disassembled and also presents a more finished appearance to the bow.

Other types of fasteners 44 such as pins, dowels, screws, clamps, clips and the like could also be used in accordance with the concepts of the present invention. Fasteners 44 of the bolt and nut type described above are presently preferred, although it is possible that the fastener which secures the end of the joint which is in compression in use (the upper end in FIG. 2) simply could be a pin or dowel within a bore since the fastener does not need to apply compressive forces.

As a general matter, the size, spacing and number of the fasteners 44 used in forming joint 16 may vary considerably and generally are particularly adapted for the specific apparatus according to, among other things, the materials utilized in constructing the bow, and the size and strength of the bow.

One manner of making archery bow 10 as shown in the drawings is to simply fabricate a unitary bow of the desired dimensions and characteristics and then saw or cut joint 16 of the type described in the bow. Suitable apparatus for performing the sawing operation may include a band saw and the like. Once mating surfaces 26 and 28 of joint 16 are formed, by applying the preferred covering layer 42 of appropriate thickness onto at least one of the mating surfaces, a volume corresponding to material of the bow lost during the cutting or sawing operation can be replaced by the cover layer. As a consequence, the shape and dimensions of the bow according to the invention correspond to those of the unitary bow before the sawing operation.

During use of the above described archery bow 10, it has been surprising found that the generation of objectionable vibrations typical to known takedown bows has been virtually eliminated. Even more surprisingly, it has been found that use of the bow according to the invention may even provide better operational characteristics, particularly in terms of reduced vibration, than a unitary bow of the same materials. In addition, the bow is easily assembled and disassembled in the fashion of conventional takedown archery bows. Furthermore, due to the non-linear shape of the joint between the components of the bow, alignment of the components is facilitated and the joint is less clearly evident to the observer and thus the bow presents a more pleasing appearance.

While there has been shown and described what is considered to be preferred embodiment of the present invention, it will be apparent to those skilled in the art to which the invention pertains that various changes and modification may be made therein without departing from the invention as defined in the appended claims.

It is claimed:

1. An archery bow having a belly and a back comprising two elongated branch components detachably joined together at a joint with at least one releasable fastener extending through holes in each component which extend from the belly to the back of the bow, the joint extending from the belly to the back and, forming the joint, an end of each component having a first curved surface extending to the bow belly and a second curved surface extending to the bow back.

2. An archery bow in accordance with claim 1, wherein each component further includes a third surface between the first and second curved surfaces.

3. An archery bow in accordance with claim 2, wherein the third surface is planar.

4. An archery bow in accordance with claim 3, wherein the bow has a longitudinal axis and the planar third surface extends generally parallel to the longitudinal axis of the bow.

5. An archery bow in accordance with claim 2, wherein the bow has a longitudinal axis and the third surface extends generally parallel to the longitudinal axis of the bow.

6. An archery bow in accordance with claim 1, wherein the first and second curved surfaces and the third surface extend generally perpendicular to side surfaces of the components.

7. An archery bow in accordance with claim 1, wherein the fastener includes a threaded bolt and nut.

8. An archery bow in accordance with claim 1, wherein a layer of flexible material is interposed between at least some of the surfaces of the ends of the components forming the joint.

9. An archery bow in accordance with claim 8, wherein the layer includes leather material.

10. An archery bow having a belly and a back comprising two elongated branch components each having an end, the ends being detachably joined together at a joint with at least one releasable fastener extending through holes in each component which extend from the belly to the back of the bow, the joint being defined by mating surfaces on the ends of each component and being between the belly and the back of the bow, the mating surfaces of each component having a first curved surface extending to the bow belly and a second curved surface extending to the bow back.

11. An archery bow in accordance with claim 10, wherein each component further includes a third surface between the first and second curved surfaces.

12. An archery bow in accordance with claim 11, wherein the third surface is planar.

13. An archery bow in accordance with claim 12, wherein the bow has a longitudinal axis and the planar third surface extends generally parallel to the longitudinal axis of the bow.

14. An archery bow in accordance with claim 11, wherein the bow has a longitudinal axis and the third surface extends generally parallel to the longitudinal axis of the bow.

15. An archery bow in accordance with claim 10, wherein the first and second curved surfaces and the third surface extend generally perpendicular to side surfaces of the components.

16. An archery bow in accordance with claim 10, wherein the fastener includes a threaded bolt and nut.

17. An archery bow in accordance with claim 10, wherein a layer of flexible material is interposed between at least some of the surfaces of the ends of the components forming the joint.

18. An archery bow in accordance with claim 17, wherein the layer includes leather material.

* * * * *